United States Patent [19]

VanTosh

[11] Patent Number: 4,672,788

[45] Date of Patent: Jun. 16, 1987

[54] METHOD AND DEVICE FOR REPAIRING VINYL SIDING AND THE LIKE

[76] Inventor: Brian H. VanTosh, 377 Hayward Ave., Rochester, N.Y. 14609

[21] Appl. No.: 902,498

[22] Filed: Sep. 2, 1986

Related U.S. Application Data

[63] Continuation-in-part of Ser. No. 797,395, Nov. 12, 1985.

[51] Int. Cl.[4] ..... E04D 1/00

[52] U.S. Cl. ..... 52/514; 52/531; 52/748; 52/520

[58] Field of Search ..... 52/520, 529, 530, 531, 52/545, 551, 514, 741, 748, 514

[56] References Cited

U.S. PATENT DOCUMENTS

| | | | |
|---|---|---|---|
| 511,384 | 12/1893 | White | 52/520 |
| 3,110,130 | 11/1963 | Trachtenberg | 52/520 |
| 3,226,901 | 1/1966 | Harter | 52/520 |
| 4,054,012 | 10/1977 | Paradisi | 52/531 |
| 4,187,661 | 2/1980 | Poiry | 52/514 |
| 4,356,673 | 11/1982 | Gailey | 52/513 |
| 4,399,643 | 8/1963 | Hafner | 52/530 |
| 4,411,117 | 10/1983 | Bolha | 52/514 |
| 4,424,655 | 1/1984 | Trostle | 52/520 |

*Primary Examiner*—Henry E. Raduazo

*Attorney, Agent, or Firm*—Shlesinger Fitzsimmons Shlesinger

[57] ABSTRACT

In an array of overlapping siding panels, which are secured to the wall of a house or the like, if the hook-shaped lower edge of a panel becomes loose or disengaged from an underlying panel, it is repaired by inserting and securing the upper edge of a repair element beneath the lower edge of the loose panel, and above the upper edge of the underlying panel, and so that a hook on the lower edge of the element engages beneath and forms and extension for a hook formed along the upper edge of the underlying panel. The hook-shaped lower edge of the loose panel is then snapped over and secured by the hook on the lower edge of the element.

4 Claims, 7 Drawing Figures

METHOD AND DEVICE FOR REPAIRING VINYL SIDING AND THE LIKE

RELATED APPLICATIONS

This application is a continuation-in-part of my pending U.S. patent application Ser. No. 797,395, filed Nov. 12, 1985 for siding saving device.

BACKGROUND OF THE INVENTION

This invention relates to the repair of plastic or metal siding for houses and the like, and more particularly to a method and novel device for repairing elongate strips or panels of siding which become dislodged after installation.

It is becoming more and more customary to cover or replace wooden housing siding or clapboard with plastic or sheet metal siding, frequently referred to as vinyl or aluminum siding, respectively. This type of siding usually is produced in elongate strips or panels, which are adapted to be nailed to the side of a house in overlapping, horizontal rows, and with a rearwardly facing, hook-shaped portion along the lower edge of each panel overlying, and releasably engaged in, a downwardly facing hook-shaped portion formed along the upper edge of the next lower panel in the assembly.

One problem often encountered with siding of the type described above is that, after installation, shrinkage or settlement of the associated building or house often causes the interconnected, or hook-shaped portions of adjacent panels to become disengaged. In other words, although the panels remain nailed or secured to the side of a house, the shrinkage of the framework of the house may cause one or more of the horizontally disposed panels to shift downwardly relative to an adjacent panel, whereby the hook-shaped lower edge of the settling panel becomes disengaged from the hook-shaped portion that extends along the upper edge of the next lower panel in the assembly. This may also occur as the result of extreme changes in temperature which causes expansion and/or contraction of the panels.

When siding panels accidentally become disengaged as noted above, it is possible to correct the matter by removing and shifting upwardly the panel which has settled, but obviously this would require removal of all of the panels located above the errant panel. The cost of doing so, of course, would be prohibitive. Alternatively, the lower edge of the panel which slipped downwardly could be simply nailed against the housing to prevent it from swinging outwardly or away from the underlying panel, but this creates an unsightly and unsatisfactory solution.

A variety of siding panels and associated mounting devices are disclosed in U.S. Pat. Nos. 3,110,130; 4,054,012; 4,399,643; 4,187,661; 4,411,117; 4,356,673 and 3,226,901, but none of these patents discloses a satisfactory method or deviice for quickly and inexpensively repairing panels which have become loose after installation. Although U.S. Pat. No. 3,226,901 discloses panel mounting hooks which are hidden from view, they are used simply to secure and to support siding panels on a housing wall, but cannot be used to repair panels which have become loose, unless the panels themselves are modified in some manner.

It is an object of this invention, therefore, to provide a relatively simple and inexpensive method for repairing panels of the type described which have settled or otherwise become disconnected from the next adjacent panel in a house or building covered by siding of the type described.

It is an object also of this invention to provide a relatively simple and inexpensive device which can be used to reconnect or repair housing panels of the type described when one has settled relative to the other after installation, and without repairing any modification whatsoever of the panels themselves.

Other objects of the invention will be apparent hereinafter from the specification and from the recital of the appended claims, particularly when read in conjunction with the accompanying drawings.

SUMMARY OF THE INVENTION

When the normally interlocked, hook-shaped portions of plastic or metal siding or panels accidentally becomes disengaged after installation, because of the vertical settling of one panel relative to the other, the disengaged portions are reconnected by the use of a siding saving device in the form of a hook-shaped lock extender. The device is inserted beneath and nailed along its upper edge to the housing beneath the loose, lower edge of the settled panel, and in such manner that a hook-shaped portion on the lower edge of the extender engages in the hook which is formed along the lower edge of the loose panel, and so that a rearwardly facing edge of such hook-shaped portion of the device engages beneath the hook which is formed along the upper edge of the next lower panel in the assembly.

In practice, the loose, or settled panel, which remains nailed at its upper edge to the housing, is pivoted manually outwardly far enough to permit the siding saving device to be inserted therebeneath, and to be secured by nails along its upper edge to the housing above the upper edge of the next lower panel in the assembly. At this time the upper edge of a rearwardly facing hook, which is formed on the lower edge of the siding saving device, is seated beneath the hook formed along the upper edge of the next lower panel. After the saving device has been nailed in place, the hook on the lower edge of the loose panel is popped by a conventional instrument over the hook formed on the lower edge of the device, which at this stage functions as an extension of the hook that runs along the upper edge of the lower panel, thus securing once again the two panels together by means of a siding saving device which is completely hidden beneath the upper panel of the pair.

THE DRAWINGS

Figure 2:
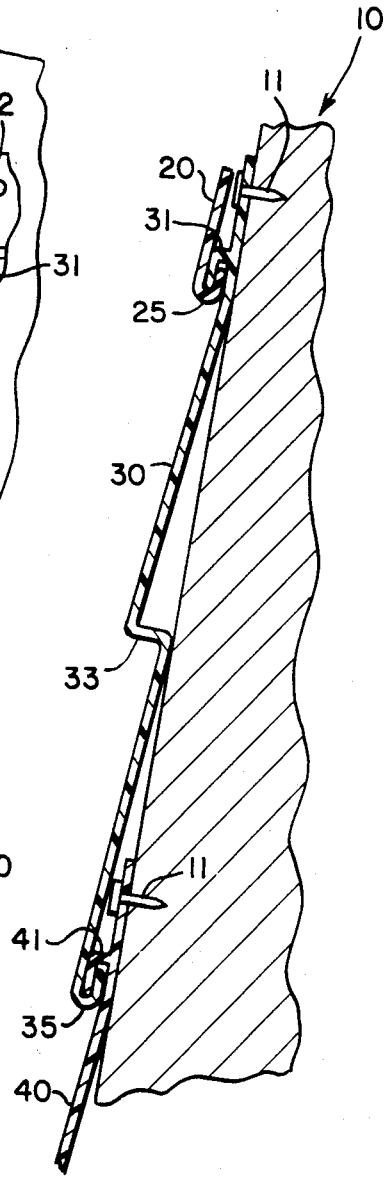
FIG. 2 is a fragmentary sectional view taken along line 2—2 in FIG. 1 looking in the direction of the arrows.
Figure 3:
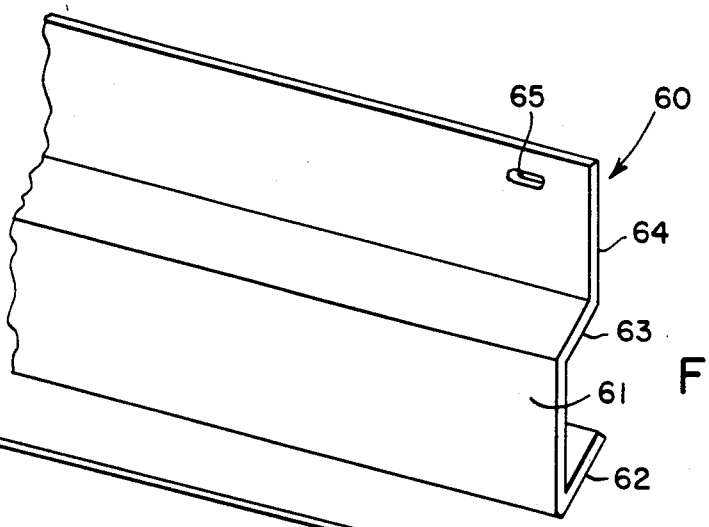
FIG. 3 is a fragmentary perspective view of the front of a novel siding saving device or lock extender which is particularly suited for use in repairing siding installations of the type shown in FIGS. 1 and 2.
Figure 4:
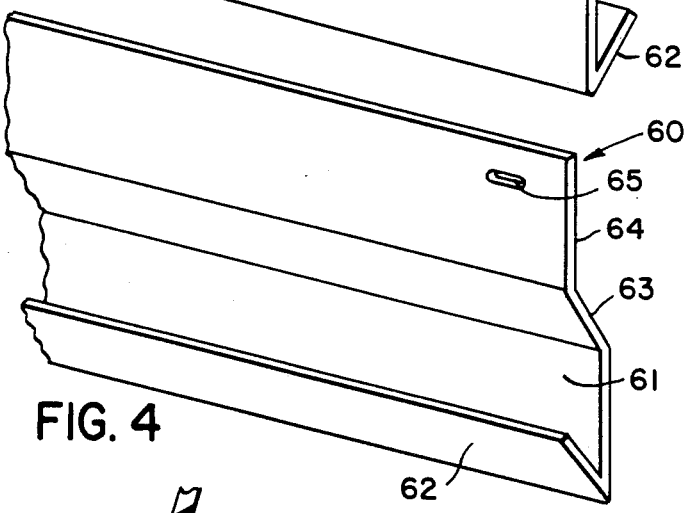
FIG. 4 is a rear perspective view of the siding saving device.
Figure 5:
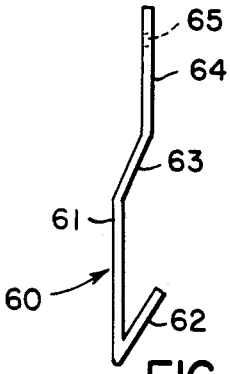
FIG. 5 is an end elevational view of this device.
Figure 6:
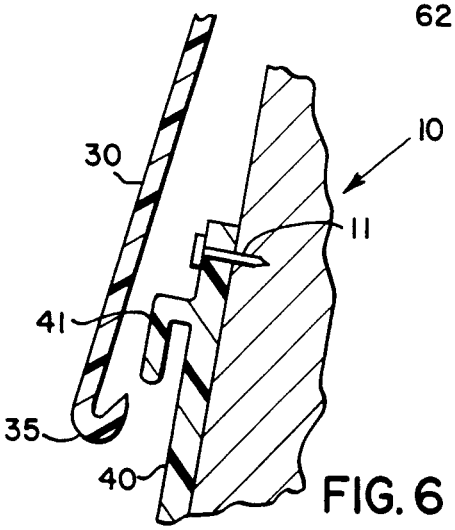
Figure 7:
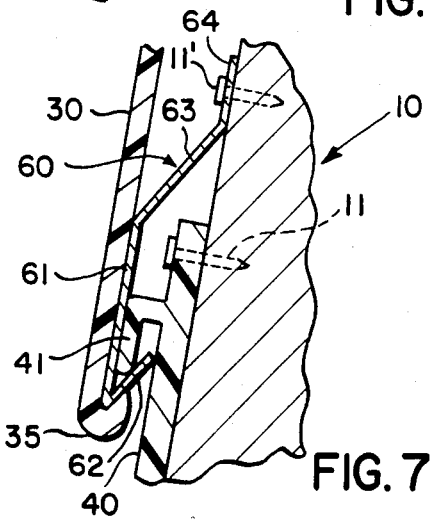

FIG. 6 is a fragmentary sectional view similar to FIG. 2, but illustrating the manner in which the lower edge of a panel of the type shown in FIG. 2 may become disconnected or unlocked from the upper edge of the next lower panel in the array because of the result of temperature changes or shrinking of the sidewall of the associated house upon which the panels are secured; and FIG. 7 is a view similar to FIG. 6, but illustrating how the saving device of FIGS. 3 to 5 is adapted to be utilized to repair or reconnect the panels shown in FIG. 6.

PREFERRED EMBODIMENTS OF THE INVENTION

Figure 1:
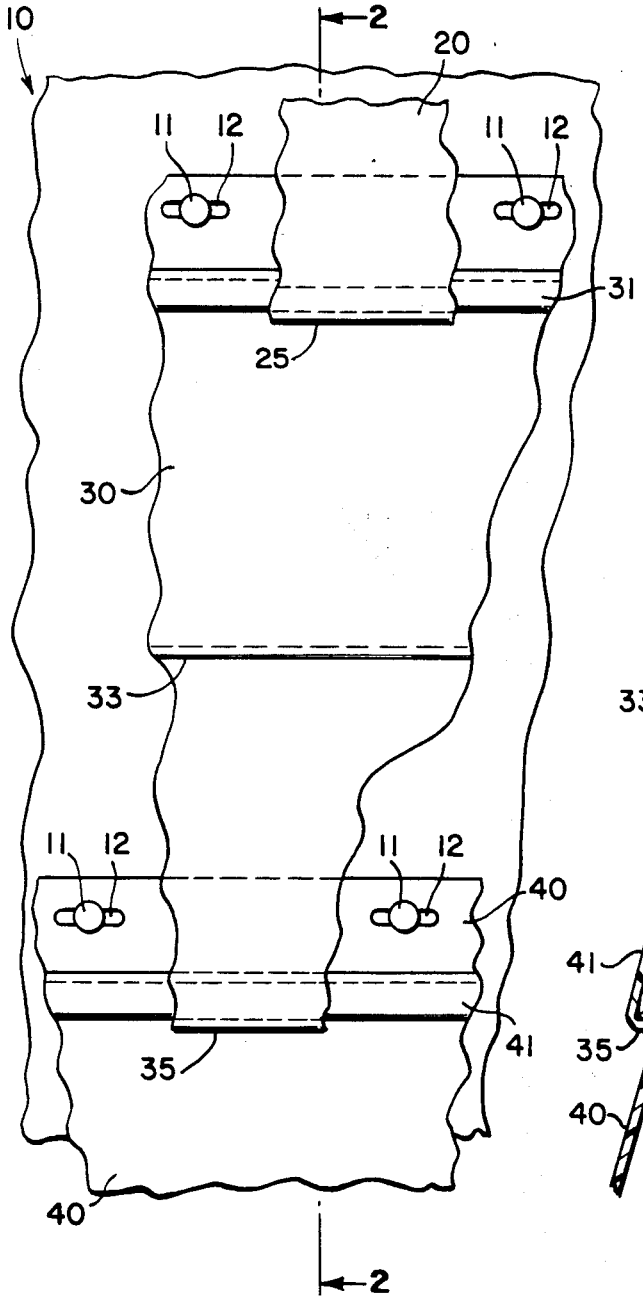
FIG. 1 is a fragmentary elevational view of the side wall of a house, or the like, having secured thereon in a conventional manner, and in overlapping, interlocking relation with each other, a plurality of conventional vinyl siding strips or panels.

Referring now to the drawings by numerals of reference, and first to FIGS. 1 and 2, 10 denotes generally the side of a house, or the like, to which has been secured an array of conventional vinyl siding strips or panels, three of which are denoted at 20, 30 and 40, respectively. As shown in FIGS. 1 and 2, the various panels in the array (including 20, 30 and 40) are secured at their upper edges by nails 11 or the like, which extend through slots or registered openings 12 formed in the upper edge of each panel for this purpose. Below the nailing slots 12 each panel is provided with an elongate, downwardly facing generally hook-shaped projection denoted on panels 30 and 40 at 31 and 41, respectively. These hook shaped portions 31, 41 extend over the face of the associated panel 30 and 40, respectively, and extend longitudinally of the panel parallel to its upper edge. Intermediate its upper and lower edges each panel is provided with a longitudinally extending bend, as shown for example in the drawing by the bend 33 formed in panel 30 substantially medially of its edges. In each panel this bend operates to offset substantially the lower half of a respective panel slightly outwardly from the surface of the housing wall 10, as shown for example by the lower half of the panel 30 as shown in FIG. 2.

Also each panel in the array is provided along its lower edge with a rearwardly facing, upturned or hook-shaped portion, as shown for example by the hook-shaped portion 25 and 35 of the panels 20 and 30, respectively.

When the siding strips or panels in the array are properly secured by nails 11 over the side 10 of a house the rearwardly facing hook-shaped portion along the lower edge of each panel (for example portions 25 and 35) has its upturned edge releasably locked or seated beneath the downwardly facing hook-shaped portion (such as portions 31 and 41) of the next lower panel in the array. Thus, when properly installed as shown in FIGS. 1 and 2, the lower edge of each panel is releasably attached or locked to the next lower panel in the array by virtue of the interengagement of the hooked shaped portion of the lower edge of each panel with the downwardly directed, hooked shaped portion formed adjacent the upper edge of the lower panel in the array.

Because of the above-noted shrinkage in the framework of the housing, or because of excessive expansion or contraction of the various panels in response to extreme temperature changes, of the various panels, it is not unusual for one or more panels in the array to become dislodged from one another as shown, for example in FIG. 6, wherein panel 30 has settled somewhat relative to panel 40, so that the lower, hook-shaped portion 35 of panel 30 has shifted downwardly relative to the hook-shaped portion 41 on the upper edge of panel 40, thus causing panel 30 to disengage from panel 40. This problem could be resolved by cutting one or more of the errant siding strips and shifting them relative to each other before renailing them to the housing side; or the various strips could be unfastened from the side of the housing and then refastened or renailed thereto, but of course this would require shifting all of the panels in order to compensate for perhaps only two of the panels which may not be properly connected.

To obviate the difficulty in repairing disconnected panels of the type shown in FIG. 6, applicant has developed a novel siding saving element which is denoted generally at 60 in FIGS. 3 to 5 and 7. Element 60 comprises an elongate sheet metal or plastic fitting which is bent or otherwise formed in intermediate its longitudinally extending, parallel edges, into four, integrally connected sections 61, 62, 63 and 64. Section 61 forms a plane, front wall or body portion of element 60, and has its lower edge integral with the lower edge of section 62, which is inclined to an acute angle upwardly and rearwardly from section 61 to form a rearwardly facing hook on the lower end of element 60. Intermediate section 63 is integral at its lower edge with the upper edge of section 61, and is also inclined rearwardly relative to section 61 and generally parallel to and in vertical registry with, the hook section 62 of the element. The upper edge of section 63 is integral with the lower edge of flange section 64, which extends above section 63 parallel to, and offset rearwardly from, the front body portion 61 of the element.

Flange section 64 may also have therethrough adjacent its upper edge one or more openings 65 to accommodate nails or similar items which may be used for securing element 60 to a housing wall as noted hereinafter.

In use, and in order to repair detached panels of the type shown in FIG. 6, the lower portion of the panel 30 as shown in FIG. 6, is pivoted or bent manually outwardly relative to its fixed, upper edge, and far enough to permit the upper flange section 64 of an element 60 to be passed beneath panel 30 and over the upper edge of the underlying panel 40, and also in such manner that the hook 62 on the lower edge of the element engages beneath the downwardly extending hook-shaped portion 41 of panel 40 (FIG. 7). The device 60 is then secured by nails 11' along its upper edge directly against the housing 10, after which the lower portion of the panel 30 is pivoted back toward the panel 41, and its hook-shaped lower end 35 is snapped or otherwise engaged around the lower end or apex of the device 60, by conventional tool, if necessary whereby the lower end of the saving device 60 becomes locked or seated in the hook-shaped lower end of panel 30 as shown in FIG. 7. The siding saving device 60 will then be completely hidden from view, and panel 30 will once again be properly secured against panel 40 without having had to strip panels from the side of the housing, or without having had to make any cut in the panels to effect the repair.

From the foregoing it will be apparent that the present invention provides a relatively simple device and a novel method for repairing vinyl or metal siding of the type frequently used in place of clapboards on houses or the like. The siding saving devices 60 can be made in various lengths; and the configuration of each device can be modified slightly if necessary, to accommodate the device for use with different types of siding. A primary advantage of this construction is that it is not necessary to remove or shift any of the panels previously secured to the housing side. Wherever necessary a saving device 60 is slipped beneath adjacent edges of two panels which have become detached from each other, and after being secured to the side of the housing by nails 11', one need only to pop or insert the hook-shaped lower edge of the errent panel over the lower end of the saving device to complete the repair. The devices 60 can be made very inexpensively because they do not bear any load whatsoever, but merely couple together the hook-shaped portions of two panels, such as for example portions 35 and 41, to prevent one from pivoting or otherwise moving away from the other.

While the present invention has been illustrated and described in connection with only certain embodiments thereof, it will be apparent that it is capable of still further modification, and that this application is intended to cover any such modifications as may fall within the scope of one skilled in the art, or the appended claims.

I claim:

1. In combination with a pair of like, adjacent siding panels, each of which is secured by first means adjacent its upper edge, and one above the other, to a wall, and with a rearwardly facing, hook-shaped portion along the lower edge of the upper panel overlying a downwardly facing hook formed on the face of the lower panel adjacent its upper edge, a siding saving device separate and independent of said first means, comprising a generally flat body portion extending between the downwardly facing hook on said lower panel and the overlying portion of said upper panel, a flange portion integral with and offset above and rearwardly of, the upper edge of said flat body portion, and disposed to be secured to said wall beneath the overlying portion of said upper panel, and a rearwardly facing hook formed along the lower edge of said body portion, and disposed to have a marginal portion along its upper edge positioned slidably beneath and in engagement with said downwardly facing hook on said lower panel, and said rearwardly facing hook-shaped portion on the lower edge of said upper panel disposed to be snapped or urged resiliently into place over said lower edge of said body portion of the device so as to engage and extend at least part way around the outside of said rearwardly facing hook on said device to be held thereby against movement relative to said lower panel.

2. The combination as defined in claim 1, wherein said hook formed along the lower edge of said body portion intersects the latter at an acute angle to form on the lower end of said device a downwardly extending apex over which the rearwardly facing hook-shaped portion of said upper panel is slidably.

3. The combination as defined in claim 1, wherein said flange portion extends over the upper edge of said lower panel, and is disposed to be secured directly against said wall.

4. The method of repairing housing siding of the type in which, in an array of siding panels which have been secured in overlapping relation to a housing wall, at least one panel in the array has become loose from an adjacent panel by virtue of a hook-shaped portion along the lower edge of said one panel having shifted downwardly and become disengaged from a cooperating hook-shaped portion on the upper edge of the underlying panel, comprising swinging the lower edge of said one panel outwardly, inserting beneath the lower edge of said one panel and over the upper edge of said underlying panel a siding repair element having on its lower edge a rearwardly facing hook positioned to engage beneath and to form an extension of the hook-shaped portion formed along the upper edge of said underlying panel, securing said repair element adjacent its upper edge to said housing wall above the upper edge of said underlying panel, and with said hook on said repair element engaged beneath said hook-shaped portion on said underlying panel, and swinging said lower edge of said one panel back toward said wall to engage said hook-shaped portion along said lower edge of said one panel over the lower edge of said repair element to be secured thereby relative to said underlying panel.

* * * * *